United States Patent [19]

Baxter et al.

[11] 4,419,907

[45] Dec. 13, 1983

[54] MULTIPLE MODE CONTROL LEVER ASSEMBLY

[75] Inventors: Kenneth D. Baxter, Cedar Falls, Iowa; Gary R. Bluem, Wayzata; Dallas R. Humphrey, Golden Valley, both of Minn.; Carl E. Kittle, Cedar Falls, Iowa; Douglas J. Kluge, Golden Valley, Minn.

[73] Assignee: Deere & Company, Moline, Ill.

[21] Appl. No.: 333,601

[22] Filed: Dec. 23, 1981

[51] Int. Cl.[3] ..... G05G 5/06

[52] U.S. Cl. ..... 74/531; 267/150

[58] Field of Search ..... 74/531, 529, 527; 267/150

[56] References Cited

U.S. PATENT DOCUMENTS

| | | | |
|---|---|---|---|
| 2,762,876 | 9/1956 | Glogau | 74/527 |
| 2,924,680 | 2/1960 | Swenson | 200/61.3 |
| 3,721,160 | 3/1973 | Kittle | 91/426 |
| 3,779,096 | 12/1973 | Hurst et al. | 74/476 |
| 3,963,051 | 6/1976 | Kuhlmann | 137/637 |
| 4,038,508 | 7/1977 | Mapelsden | 74/531 X |
| 4,215,771 | 8/1980 | Huitema | 192/3.54 |
| 4,222,474 | 9/1980 | Choudhury et al. | 192/0.096 |
| 4,259,878 | 4/1981 | Anderson | 74/491 |

OTHER PUBLICATIONS

Exhibit Relating to Control Levers Manufactured by OEM Controls Inc. (4 pages).

*Primary Examiner*—Kenneth Dorner
*Assistant Examiner*—Anthony W. Raskob, Jr.

[57] ABSTRACT

A multiple mode control lever assembly includes a lever fixed for rotation with a disk rotatable on a central pivot in a housing. The disk includes detent recesses and carries a brake segment. A detent element is pivotal about a second pivot and carries a roller engageable with the detent recesses. A brake element is also pivotal about the second pivot and carries a brake shoe engageable with the brake segment. An index cam is rotatable on the central pivot to couple and uncouple the detent and friction elements from the disk. The index cam is rotated by a ratchet with a pawl reciprocated by a solenoid fixed in the housing. A centering spring continuously coupled between the housing and the disk urges the lever to a neutral position.

16 Claims, 11 Drawing Figures

MULTIPLE MODE CONTROL LEVER ASSEMBLY

BACKGROUND OF THE INVENTION

This invention relates to an operator-movable, single lever control lever assembly with friction-held, detent-held and spring-centered operational modes.

It is well known to use manual control levers to remotely control hydraulic functions, such as hydraulic motors or cylinders. For example, friction-held control levers are used to remotely control implement hitches on agricultural vehicles wherein the control lever is moved to a friction-held displaced position to cause the hitch to raise or lower to a new position corresponding to the displaced control lever position. A friction-held control lever is also used to control the rotation speed of hydraulic motors where the rotation speed is maintained at a value corresponding to the control lever position. Spring-centered and detent-held control levers are used to control hydraulic functions through a selective control valve, as described in U.S. Pat. No. 3,721,160. In such an application, the control lever is moved to a detent-held displaced position to hydraulically extend or retract a hydraulic cylinder. When the actuated hydraulic cylinder reaches the end of its stroke, the detent is automatically released by a pressure, flow or time signal and the lever returns to its neutral position under the influence of a centering spring, whereupon the cylinder is held in the extended or retracted position.

Where both friction-held and spring-centered operational modes have been required, it has heretofore been necessary to provide a separate friction-held control lever and a separate spring-centered control lever for each operational mode. This has been expensive and takes up valuable space on an operator's control panel. One solution to this problem is disclosed in U.S. patent application, Ser. No. 307,704, filed Oct. 2, 1981 and assigned to the assignee of the present application. However, in that design, the mode-selecting solenoid is pivotal with the movable lever, thus subjecting the connecting electrical wires to wear from repeated flexing. Also, that design was energy-inefficient because the mode-selecting solenoid had to be constantly energized during its spring-centered operational mode. Furthermore, in that design, the friction force provided by the friction disks was somewhat less than desirable. Accordingly, it would be desirable to provide a multiple mode single lever control lever assembly with improved durability, energy utilization and friction capabilities.

SUMMARY OF THE INVENTION

An object of the present invention is to provide a multiple mode control lever assembly with good frictional holding characteristics in its friction-held operational mode.

Another object of the present invention is to provide a multiple mode control lever assembly with energy-efficient mode selecting.

A further object of the present invention is to provide a multiple mode control lever assembly with a mode-selecting solenoid drive which is fixed to the assembly housing.

These and other objects and advantages are achieved by the present invention which includes a lever fixed for rotation with a pivot member pivotally mounted in a housing on a central pivot. An index cam is also pivotal on the central pivot. A second pivot pivotally supports a friction element and a detent element. A solenoid fixed in the housing reciprocates a pawl to rotate the index cam via a ratchet wheel. As the index cam rotates, it couples and uncouples the friction and detent elements from the pivot member. A centering spring continuously urges the pivot member from a displaced position to a neutral position. The friction element carries a brake shoe which is biased toward engagement with a brake segment carried by the pivot member. The detent element carries a detent roller biased toward engagement with recesses on the pivot member. A detent release solenoid is operable to pull the detent roller away from the detent recesses.

DETAILED DESCRIPTION

Figure 1:
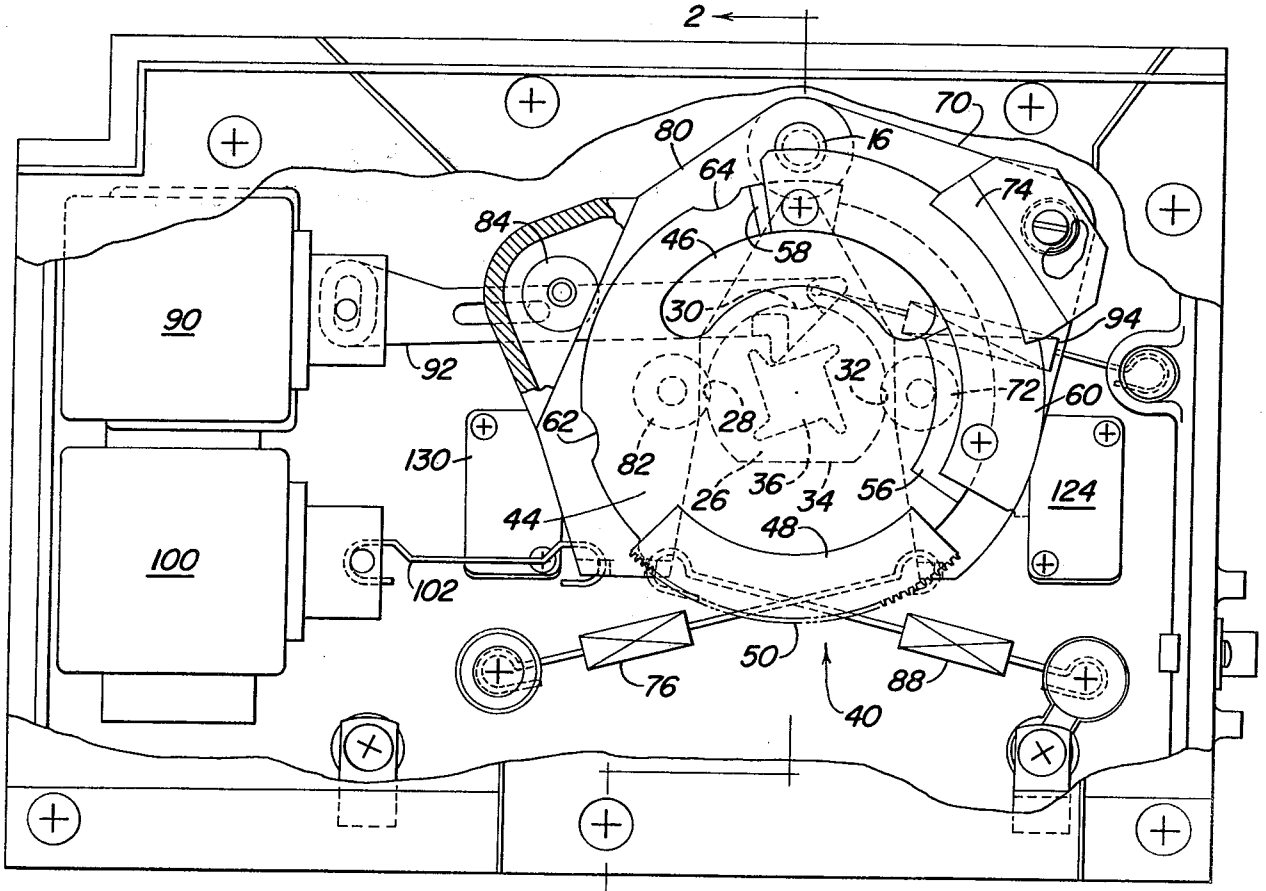
FIG. 1 is an assembly view of the present invention.

A multiple mode control lever assembly 10 includes a housing 12 which non-rotatably supports a pivot pin 14 and a pivot pin 16. An opening 18 in one side of the housing 12 rotatably supports the shaft 20 of an operator-movable control lever 22 via bearings 24. The shaft 20 rotatably receives an end of pivot pin 14. A portion of the housing 12 forms a spring post 19 extending inwardly therefrom.

Pivot pin 14 rotatably supports an index cam 26. As best seen in dashed line in FIG. 1, the cam 26 includes a hub portion with three recesses 28, 30 and 32 and a flat 34 in its outer peripheral surface. A ratchet member 36 with four ratchet teeth projects axially from the hub of index cam 26.

Figure 3:
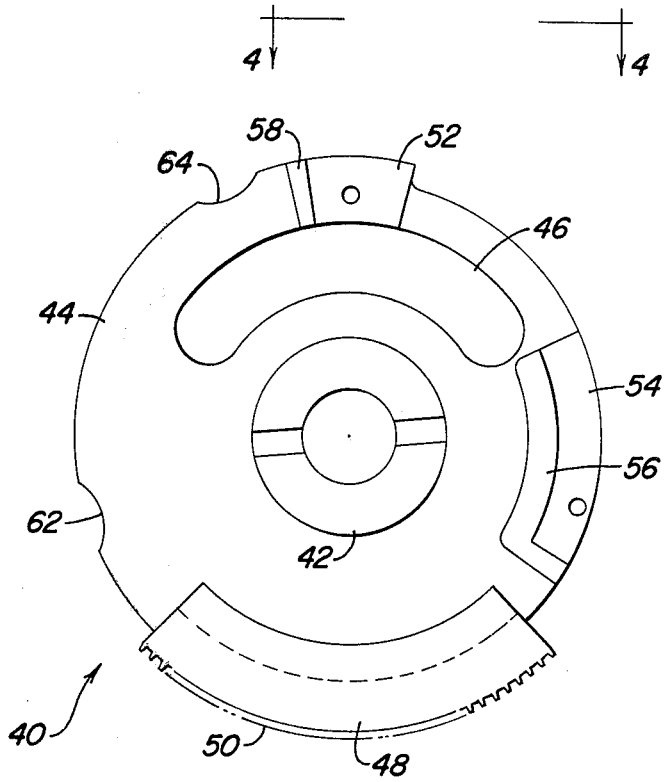
FIG. 3 is a view of the pivot member of the present invention.
Figure 4:
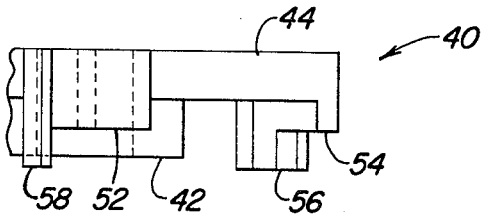
FIG. 4 is a view taken along lines 4—4 of FIG. 3.

A pivot member 40 is mounted on the lever shaft 20 and fixed for rotation therewith via pin 41. Pivot member 40 includes a central cylindrical hub 42 and a substantially disk-shaped portion 44 in which is formed a curved slot 46. A toothed gear segment 48 extends from part of the disk 44 and includes a rack 50 of gear teeth on an outer peripheral surface. A pair of raised segments or posts 52 and 54 project outwardly from the disk portion 44, each including a threaded hole therein. Post 54 is backed by a generally L-shaped piece 56 (viewing FIG. 3) which projects beyond the flat surface of post 54. Adjacent to post 52 is a tab 58 which projects beyond the flat surface of post 52. The flat surfaces of posts 52 and 54 lie in a single plane so that they can support brake segment 60 which is suitably attached thereto in proper alignment by butting against tab 58 and piece 56. A pair of detent recesses 62 and 64 are formed in the outer peripheral surface of part of the disk portion 44.

Figure 6:
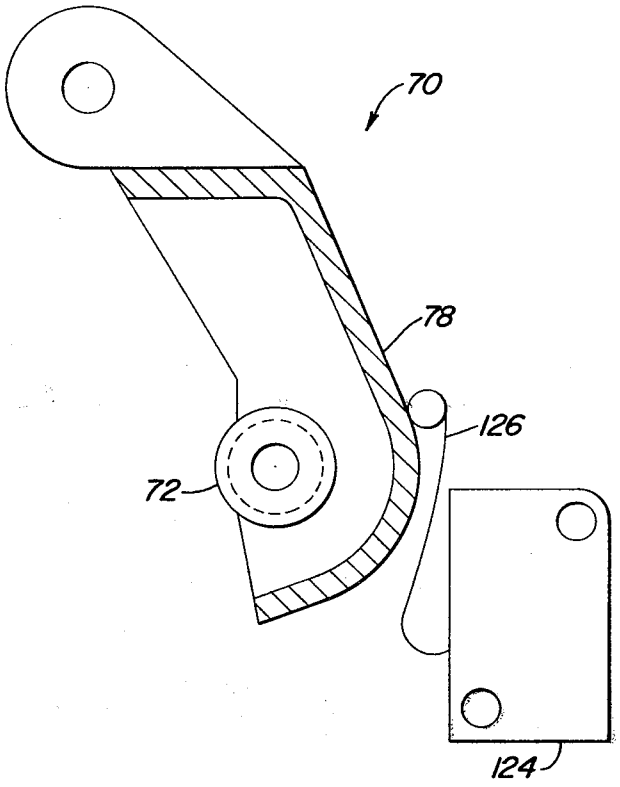
FIG. 6 is a sectional view along line 6—6 of FIG. 5.
Figure 5:
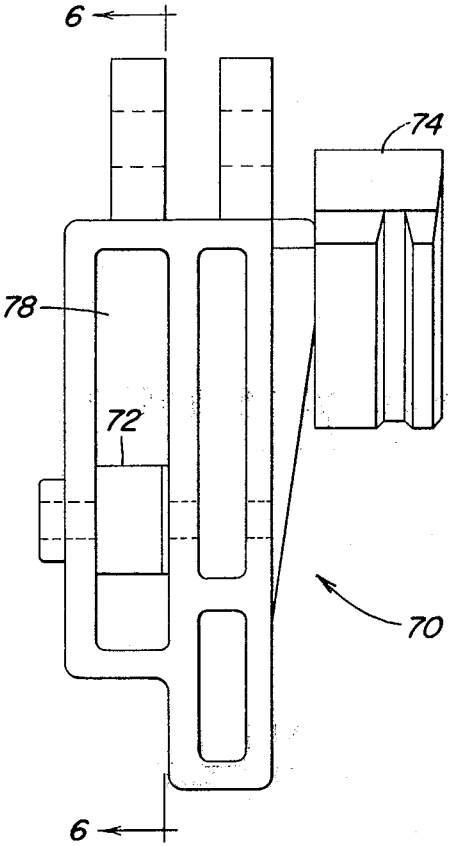
FIG. 5 is a view of the brake element of the present invention.
Figure 8:
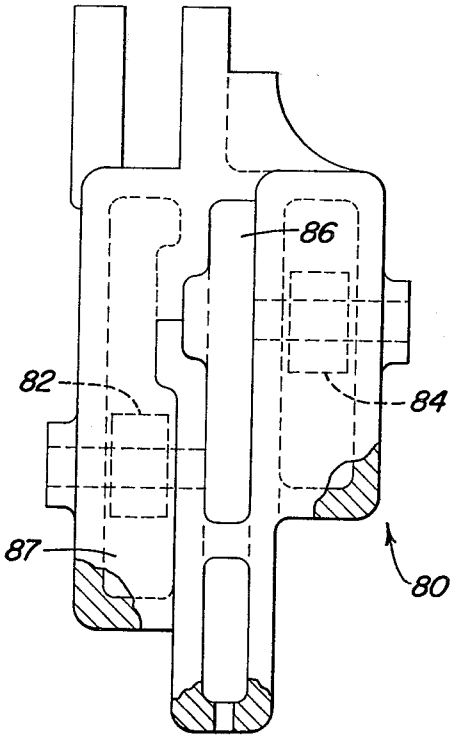
FIG. 8 is a view in the direction of arrows 8—8 of FIG. 7.

A brake element 70 is pivotal about pivot pin 16 and rotatably carries an index cam engaging roller or follower 72. A brake shoe 74 of suitable friction material is fixed to and carried by the brake element 70. A spring 76 coupled between the housing 12 and an aperture in an end of the brake element 70 is biased to urge the index roller 72 towards the index cam 26 and the brake shoe 74 towards the brake segment 60. The brake element 70 includes a wall 78, the edge of which is seen in FIG. 6, and which partially encloses the roller 72.

Figure 7:
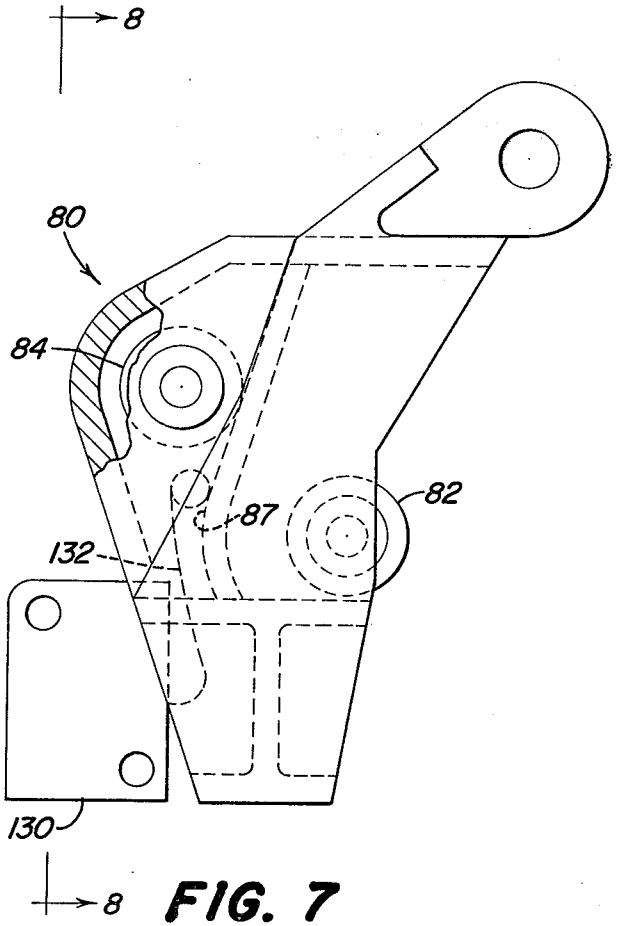
FIG. 7 is a view of the detent element of the present invention.

A detent element 80 is also pivotal about the pivot pin 16. Detent element 80 rotatably supports an index cam engaging roller or follower 82 and a detent recess engaging roller or follower 84 in respective pockets. A central opening 86 extends completely through the detent element 80. A wall 87, seen on edge in dashed line in FIG. 7, partially encloses the roller 82. A spring 88 anchored to the housing 12 and to an end of the detent element 80 is biased to urge the index roller 82 towards the index cam 26 and the detent roller 84 towards the pivot member 40.

An index drive solenoid 90 is mounted in the housing 12 and is operatively connected to reciprocate a pawl 92 which extends through the opening 86 in detent element 80 and engages the ratchet teeth on ratchet 36. A spring 94 pulls pawl 92 to the right, viewing FIG. 1. The solenoid 90 may be energized to pull pawl 92 to the left, viewing FIG. 1 to rotate index cam 26 counterclockwise approximately $\frac{1}{4}$ of a revolution each time the solenoid 90 is energized.

A detent release driver solenoid 100 is coupled to detent element 80 via link 102 so that the detent roller 84 may be pulled out of detent recesses 62 or 64 when solenoid 100 is energized.

Figure 2:
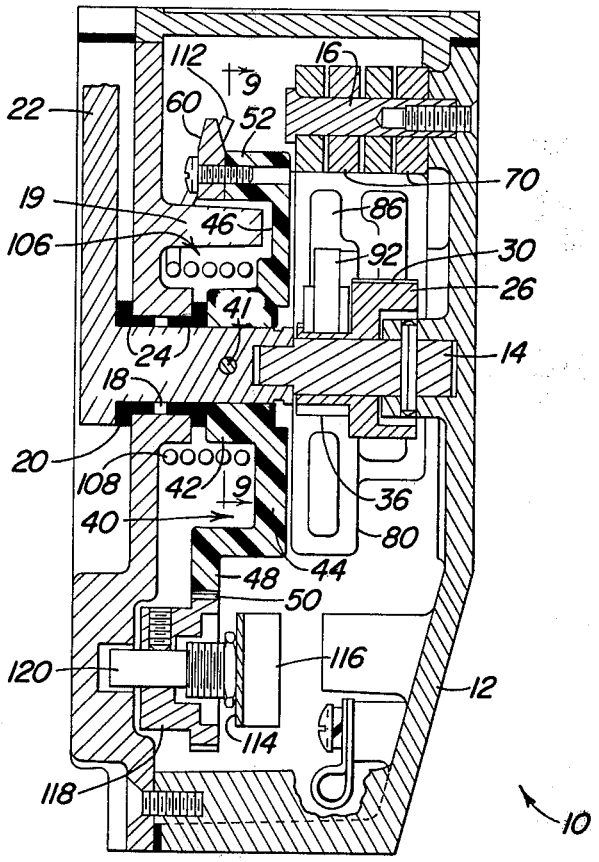
FIG. 2 is a sectional view, along lines 2—2 of FIG. 1.
Figure 9:
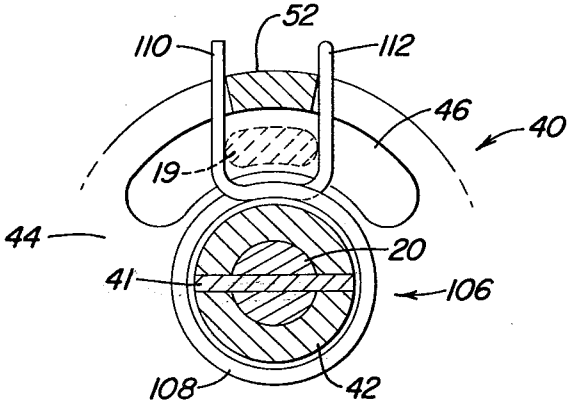
FIG. 9 is a view of a portion of the present invention in the direction of arrows 9—9 of FIG. 1.

A centering spring 106, best seen in FIGS. 2 and 9, includes a coil 108 surrounding the hub 42 of pivot member 40 and a pair of arms 110 and 112 engaging post 52 of pivot member 40 and post 19 of the housing 12. The arms 110 and 112 of the centering spring 106 are preloaded to urge the pivot member 40 to a neutral position wherein the detent roller 84 is positioned equidistant from detent recesses 62 and 64.

A bracket 114 fixed to the housing 12 supports a rotary potentiometer 116. A gear wheel 118 is mounted for rotation with the shaft 120 of potentiometer 116 so that the gear wheel 118 meshes with the gear teeth 50 of the pivot member 40. In this manner, the potentiometer 116 rotates as the pivot member 40 pivots with lever 22 to provide a signal representing the position of the lever 22.

A micro-switch 124 mounted in the housing 12 includes an element 126 (best seen in FIG. 6) which engages the wall 78 of brake element 70 so that the micro-switch 124 may be closed when the brake element is pivoted clockwise, viewing FIG. 1, as when flat 34 is oriented towards roller 72 and the control lever assembly 10 is in its friction operational mode. Another microswitch 130 mounted in the housing 12 includes a toggle element 132 (shown in dashed line in FIG. 7) which engages wall 87 of detent element 80 so that micro-switch 130 may be closed when detent element 80 is pivoted counterclockwise, viewing FIG. 1, as when flat 34 is oriented towards roller 82 and the control lever assembly 10 is in its spring-centered and detented operational mode. Thus, the status of micro-switches 124 and 130 gives an indication of the operational mode of the lever assembly 10.

MODE OF OPERATION

When the index cam 26 is positioned, as shown in FIG. 1, rollers 82 and 72 are engaged with recesses 28 and 32, respectively, detent roller 84 is spaced apart from the peripheral surface of pivot member 40 and brake shoe 74 is spaced apart from brake segment 60 so the that the detent element 80 and the brake element 70 are operatively uncoupled from the pivot member 40 and the lever 22. In this mode, only the centering spring 106 is operably coupled to the pivot member 40 to urge pivot member 40 and lever 22 to a neutral position as they are rotated to a displaced position by an operator. An identical operational mode exists when the flat 34 faces upwards, viewing FIG. 1. These operational modes may be described as spring-centered without detent.

Figure 10:
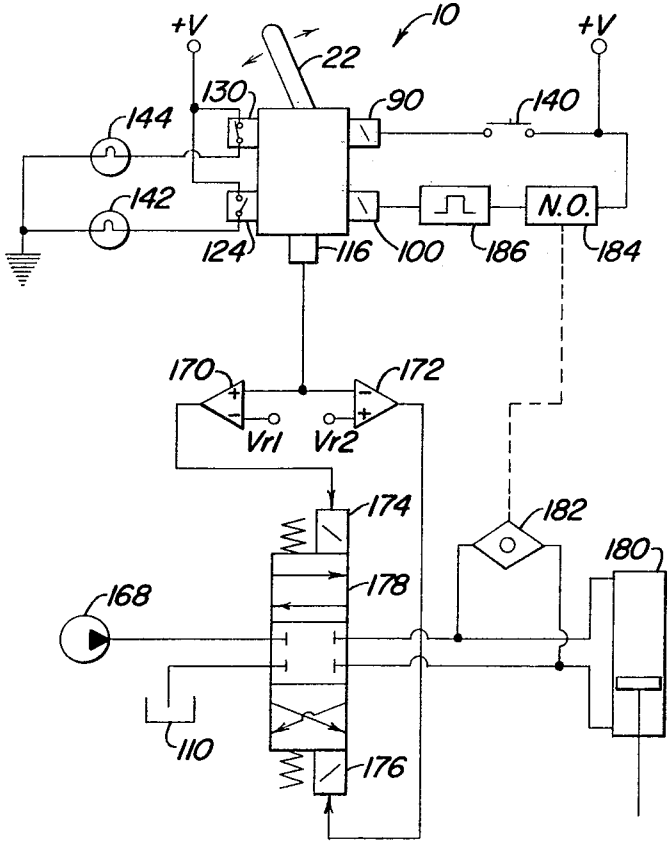

The spring-centered detent-held operational mode may best be understood with reference to FIG. 10. The system shown in FIG. 10 is merely exemplary and forms no part of the present invention. To obtain this operational mode, switch 140 is momentarily closed the appropriate number of times so that the index cam 26 is rotated so that flat 34 is facing roller 82 of detent element 80 and spring 88 pulls detent roller 84 of detent element 80 into engagement with the surface of pivot member 40 while index cam 26 holds brake element 70 spaced apart from brake segment 60. In this case, switch 130 is closed to energize an indicator device such as lamp 144 and switch 124 is open to de-energize lamp 142 to indicate that the assembly 10 is in the spring-centered, detent-held mode. Now, the lever 22 and pivot member 40 may be rotated against the bias of centering spring 106. Depending upon which direction the lever 22 is pivoted, then either comparator 170 or 172 changes to a high output condition from its normally low condition, depending upon the relationship between the signal from potentiometer 116 and reference level signals Vr1 and Vr2. Depending upon which comparator goes high, then either solenoid 174 or 176 of solenoid-operated valve 178 is energized, causing extension or retraction, respectively, of cylinder 180. If the lever 22 is pivoted far enough, then the detent roller 84 falls into either of detent recesses 62 or 64 to hold the lever 22 in its displaced position. When cylinder 180 reaches the end of its stroke, a pressure buildup on either side of its piston is communicated via check valve 182 to close a normally open pressure-operated switch 184. The closing of switch 184 causes one-shot 186 to momentarily energize detent release solenoid 100 to pivot detent element 180 clockwise, viewing FIG. 1, to pull roller 84 out the detent recess 62 or 64 and to allow lever 22 and pivot member 40 to rotate back to their neutral position under the influence of centering spring 106, whereupon both comparators 170 and 172 are low and valve 187 returns to its center position to prevent further movement of cylinder 180 until the control lever 22 is moved again. Alternatively, a flow related or timed signal could be used to close a switch to actuate one-shot 186.

Figure 11:
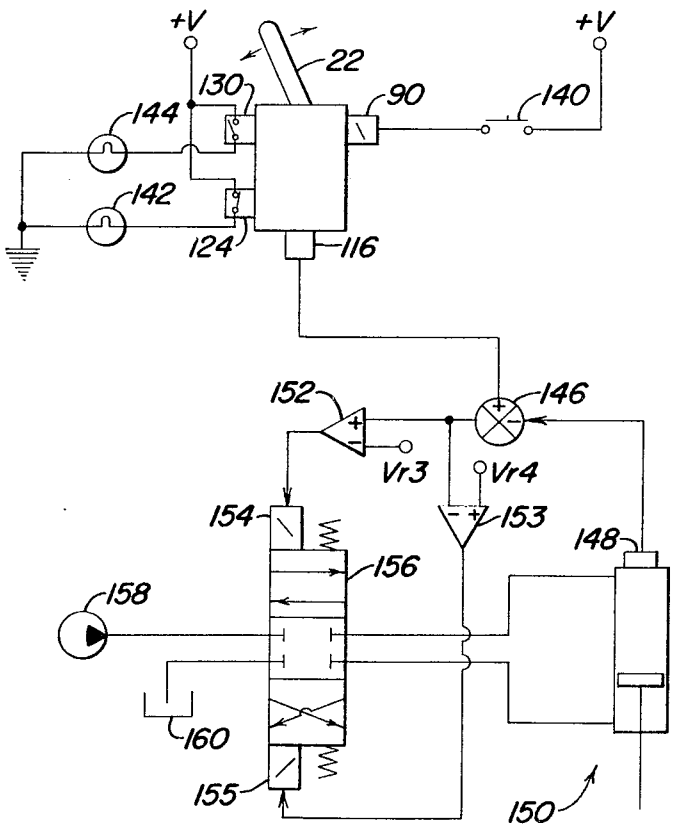
FIGS. 10 and 11 are schematic views of exemplary systems utilizing the functional modes of the present invention.

The friction-held operational mode may best be understood with reference to FIG. 11. The system shown in FIG. 11 is merely exemplary and forms no part of the present invention. To obtain this operational mode, the switch 140 is momentarily closed the appropriate number of times to cause solenoid 90 to rotate the index cam 26 so that flat 34 faces roller 72, then spring 76 pivots brake element 70 and pulls brake shoe 74 into frictional engagement with brake segment 60 while index cam 26 holds roller 84 of detent element 80 spaced apart from pivot member 40. This opens switch 130 and closes switch 124 to energize and de-energize, respectively, indicator devices, such as lamps 142 and 144. Thus, an energized lamp 142 indicates that the lever assembly 10 is in the friction-held mode. Now, when the lever 22 and the pivot member 40 are rotated, they will be held in a displaced position by the frictional engagement between brake shoe 74 and brake segment 60. Spring 76 must be of sufficient strength to permit this frictional engagement to overpower the centering bias of centering spring 106, since the centering spring 106 is never uncoupled from pivot member 40. In this case, the signal from potentiometer 116 is applied to an input of an error detector or difference generator 146. The other input of error detector 146 receives a feedback position signal from a position transducer 140 of a hydraulic cylinder 150, such as described in U.S. Pat. No. 3,726,191. The error signal from error detector 146 is received by comparators 152 and 153, one of which will turn on to energize one of solenoids 154 or 155 of a solenoid-operated control valve 156, such as a conventional 2-stage valve with a solenoid-operated pilot stage. Valve 156 controls fluid communication between pump 158, pump 160 and cylinder 150 to move cylinder 150.

When the lever 22 is moved, and the error signal falls outside of a deadband range defined by deadband reference voltages Vr3 and Vr4, then solenoid 154 or 155 will cause valve 156 to move cylinder 150 to a new position corresponding to the new position of lever 22. At this point, the error signal from error detector 146 is reduced, solenoids 154 and 155 are de-energized and valve 156 returns to its center position to hold cylinder 150 in the new position until further movement of lever 22.

We claim:

1. A multiple mode control lever assembly comprising:

a housing;

an operator-movable control lever;

pivot means for rotatably coupling the control lever to the housing;

a friction member for slidably engaging the control lever to resist rotation of the control lever relative to the housing, the friction member having a cam follower projecting therefrom;

a resilient member biased to urge the control lever from a displaced position to a neutral position;

an index cam mounted in the housing for rotation independent of the control lever and having can surfaces engageable with the follower, the index cam being rotatable between a first position wherein a first cam surface faces the follower to permit the friction member to slidably engage the control lever and a second position wherein a second cam surface engages the follower to hold the friction member spaced apart from the control lever; and an index actuator mounted in the housing and including means for rotating the index cam among its positions.

2. The invention of claim 1, further comprising:

transducer means mounted in the housing and engaging the control lever for generating signals representing the position of the control lever relative to the housing.

3. The invention of claim 1, further comprising:

a friction member spring coupled between the housing and the friction member and biased to urge the friction member into engagement with the control lever.

4. The invention of claim 1, wherein:

the control lever includes a disk member rotatable about the pivot means, the disk member having a flange projecting axially and radially from a portion thereof; and the friction member includes a brake shoe engageable with the control lever flange.

5. The invention of claim 1, wherein:

the index cam includes a ratchet member; and the index actuator includes a pawl reciprocal in the housing and engageable with the ratchet member to rotate the index cam.

6. A multiple mode control lever assembly comprising:

a housing;

an operator-movable control lever having detent recesses on a peripheral surface thereof;

pivot means for rotatably coupling the control lever to the housing;

a friction member for slidably engaging the control lever to resist rotation of the control lever relative to the housing, the friction member carrying a cam follower therewith;

a resilient member biased to urge the control lever from a displaced position to a neutral position;

a detent member pivotal in the housing, carrying a detent follower engageable with the peripheral surface of the control lever, and carrying a cam follower therewith;

an index member rotatably mounted in the housing and having first and second cam surfaces engageable with the cam followers of the friction member and of the detent member, the index member being rotatable between a first position wherein the second cam surface engages both cam followers to prevent the friction member from slidably engaging the control lever and to prevent the detent follower of the detent member from being received by the detent recess of the control lever, a second position wherein the first cam surface is oriented towards the cam follower of the detent member to permit the detent follower to be received by the detent recess to hold the control lever in a displaced position and wherein the second cam surface engages the cam follower of the friction member to prevent engagement between the friction member and the control lever, and a third position wherein the first cam surface is oriented towards the cam follower of the friction member to permit engagement between the friction member and the control lever, and wherein the second cam surface engages the cam follower of the detent member to prevent the detent follower from being received by the detent recesses of the control lever; and an index actuator mounted in the housing and including means for rotating the index cam relative to the housing, the friction member and the detent member.

7. The invention of claim 6, further comprising:

a detent spring biased to urge the detent member towards the control lever; and a friction spring biased to urge the friction member towards the control lever.

8. The invention of claim 6, wherein:

the friction member and the detent member are pivotal about a common pivot spaced apart from the control lever pivot means.

9. The invention of claim 6, wherein:

the index cam includes a ratchet member; and the index member includes a pawl reciprocal in the housing and engageable with the ratchet member to rotate the index member.

10. The invention of claim 9, wherein:

one of the friction and detent members includes an opening through which the pawl extends.

11. The invention of claim 7, further comprising:

a detent actuator mounted in the housing and operable to pivot the detent member to disengage the detent follower from the peripheral surface of the control lever.

12. A multiple mode control lever assembly comprising:

a housing;

an operator-movable control lever;

first pivot means for rotatably supporting the control lever in the housing;

a friction member for slidably engaging the control lever to resist rotation of the control lever;

second pivot means spaced apart from the first pivot means for rotatably supporting the friction member;

a resilient member biased to urge the control lever from a displaced position to a neutral position;

means for rotating the friction member to a first position wherein the friction member slidably engages the control lever regardless of the control lever position and wherein the control lever may be frictionally held by the friction member in any position with respect to the housing and for rotating the friction member to a second position wherein the friction member is spaced apart from the control lever regardless of the control lever position and wherein the control lever is acted upon only by the resilient member.

13. The invention of claim 12, further comprising:

transducer means mounted in the housing and engaging the control lever for generating signals representing the position of the control lever relative to the housing.

14. The invention of claim 12, wherein the means for rotating comprises:

an index cam having a ratchet rotatable on the first pivot means and having a cam surface engaging a follower projecting from the friction member; and a pawl engaging the ratchet to rotate the index cam upon reciprocation of the pawl.

15. A multiple mode control lever assembly comprising:

a housing;

a pivot member pivotal in the housing having a disc portion and a central hub, the disc having detent recesses on a peripheral surface thereof, the disc carrying a friction shoe therewith and having a spring-engaging tab projecting therefrom;

an operator-movable control lever fixed for rotation with the pivot member;

a friction member pivotal in the housing, engageable with the friction shoe to resist rotation of the control lever and carrying a cam follower therewith;

a centering spring having a coil surrounding the hub and having arms engageable with the tab and the housing and biasing to urge the pivot member from an angularly displaced position to a neutral position;

a detent member pivotal in the housing, carrying a detent follower engageable with the peripheral surface of the disc, and carrying a cam follower therewith; and actuator means movable in the housing for rotating the index member among its first, second and third positions.

16. A multiple mode control lever assembly comprising:

a housing;

an operator-movable control lever;

first pivot means for rotatably supporting the control lever in the housing;

a friction member for slidably engaging the control lever to resist rotation of the control lever;

second pivot means spaced apart from the first pivot means for rotatably supporting the friction member;

a resilient member biased to urge the control lever from a displaced position to a neutral position;

means for rotating the friction member to a first position wherein the friction member slidably engages the control lever and for rotating the friction member to a second position spaced apart from the control lever, the means for rotating comprising an index cam having a ratchet rotatable on the first pivot means and having a cam surface engaging a follower projecting from the friction member, and a pawl engaging the ratchet to rotate the index cam upon reciprocation of the pawl.

* * * * *

UNITED STATES PATENT AND TRADEMARK OFFICE

CERTIFICATE OF CORRECTION

PATENT NO. : 4,419,907

DATED : 13 December 1983

INVENTOR(S) : Kenneth D. Baxter; Gary R. Bluem; Dallas R. Humphrey; Carl E. Kittle and Douglas J. Kluge It is certified that error appears in the above-identified patent and that said Letters Patent is hereby corrected as shown below:

Column 5, line 54, delete "can" and insert -- cam --.

Column 8, line 21, delete "biasing" and insert -- biased --.

Signed and Sealed this

*Thirty-first* Day of *July 1984*

[SEAL]

*Attest:*

GERALD J. MOSSINGHOFF

*Attesting Officer*

*Commissioner of Patents and Trademarks*